US005476331A

United States Patent [19]

Ohama

[11] Patent Number: 5,476,331

[45] Date of Patent: Dec. 19, 1995

[54] PRINTER HAVING PRINT HEAD POSITION SENSOR AND MECHANISM FOR INHIBITING PRINT HEAD MOVEMENT WHEN RIBBON HOLDER IS NOT IN INITIAL POSITION

[75] Inventor: Takashi Ohama, Toyoake, Japan

[73] Assignee: Brother Kogyo Kabushiki Kaisha, Aichi, Japan

[21] Appl. No.: 337,430

[22] Filed: Nov. 8, 1994

[30] Foreign Application Priority Data

Nov. 19, 1993 [JP] Japan ..... 5-290633

[51] Int. Cl.[6] ..... B41J 35/20

[52] U.S. Cl. ..... 400/216; 400/216.1; 400/210.2; 400/279; 400/705.1

[58] Field of Search ..... 400/320, 74, 279, 400/216.2, 54, 211, 212, 215, 215.2, 215.3, 216, 216.1, 248.1, 705, 705.1

[56] References Cited

U.S. PATENT DOCUMENTS 4,725,157 2/1988 Nakai et al. ..... 400/693
5,074,690 12/1991 Del Signore, II et al. ..... 400/279
5,080,511 1/1992 Iwata .
5,112,150 5/1992 Iwata ..... 400/216.2
5,353,360 10/1994 Obara ..... 400/693

FOREIGN PATENT DOCUMENTS 63-165177 7/1988 Japan .

*Primary Examiner*—Ren Yan
*Assistant Examiner*—John S. Hilten
*Attorney, Agent, or Firm*—Oliff & Berridge

[57] ABSTRACT

A printer wherein a zero position sensor generates a zero-position signal and a non-zero-position signal depending upon whether the print head is placed in its zero position or not, and a print head locking mechanism is provided for permitting print head movement from the zero position when a ribbon holder supporting one or more ribbons is placed in a predetermined initial position, and inhibiting the print head movement from the zero position when the ribbon holder is not in the initial position, so that the non-zero-position signal is generated if the print head is moved away from the zero position with the ribbon holder placed in the initial position. When the ribbon holder is not in the initial position, the print head is not moved away from the zero position and the zero-position signal remains even if the print head is commanded to move away from the zero position, so that the single zero position sensor cooperates with the locking mechanism to detect both the print head zero position and the ribbon holder initial position.

12 Claims, 9 Drawing Sheets

FIG. 4
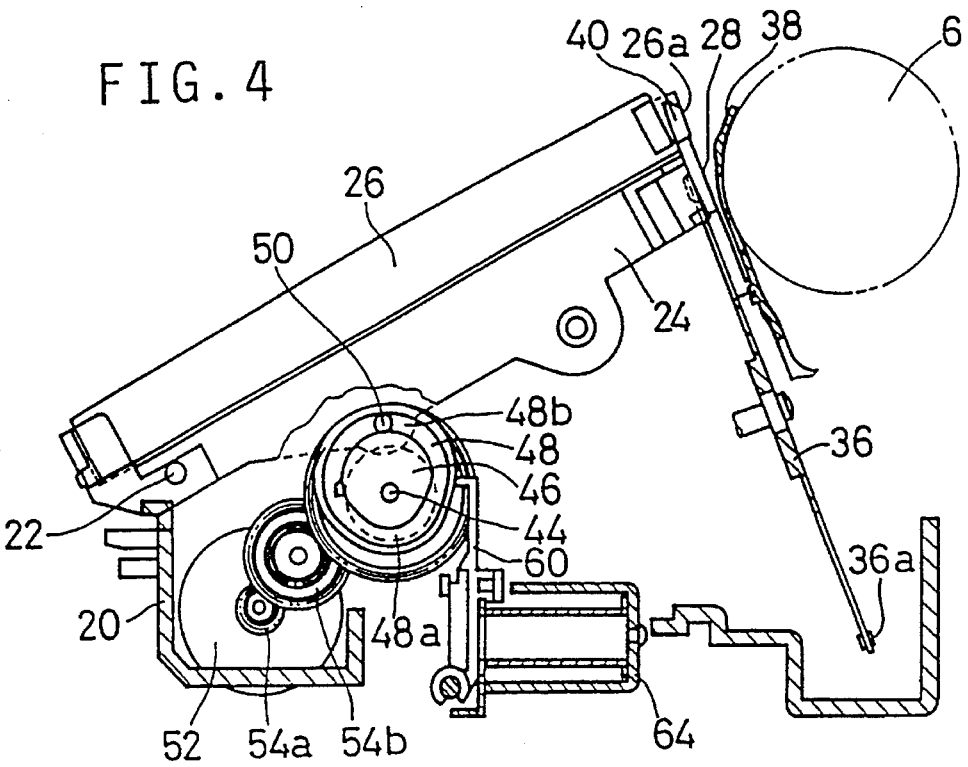
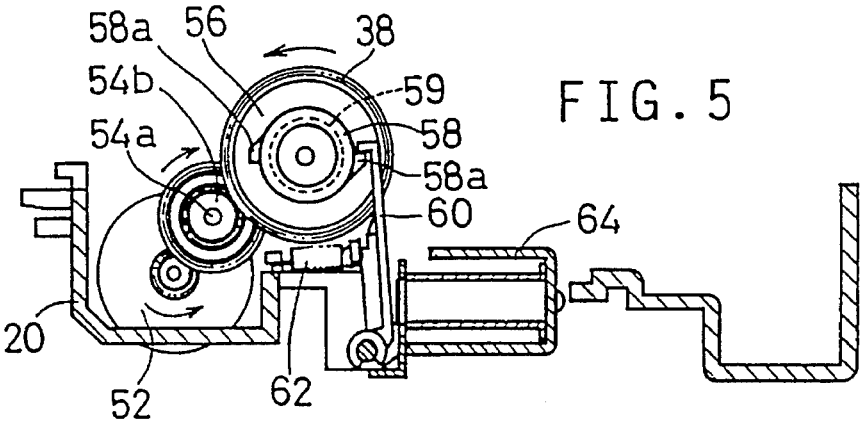
FIG. 5
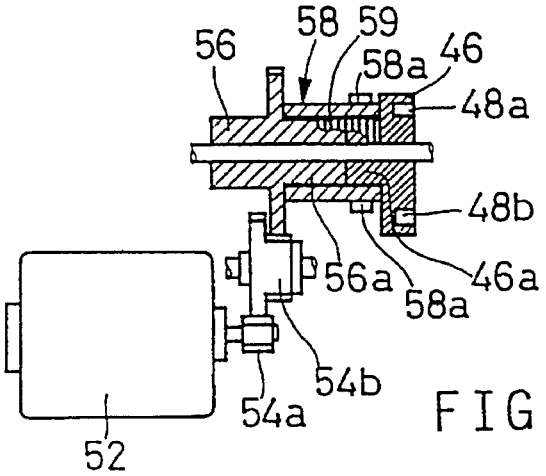
FIG. 6

PRINTER HAVING PRINT HEAD POSITION SENSOR AND MECHANISM FOR INHIBITING PRINT HEAD MOVEMENT WHEN RIBBON HOLDER IS NOT IN INITIAL POSITION

BACKGROUND OF THE INVENTION

1. Field of the Invention

The present invention relates to a printing apparatus wherein a ribbon holder for holding a ribbon or ribbons is initially placed in a predetermined initial position. More particularly, this invention relates to improvements relating to initialization of such printing apparatus wherein a print head is moved along a line of printing to a predetermined zero position while the ribbon holder is brought to a predetermined initial position.

2. Discussion of the Related Art

Usually, a ribbon holder used in a printer is adapted to support a plurality of ribbons including at least one printing ribbon for printing on a recording medium. The ribbons may include a correction ribbon for erasing printed characters. The ribbon holder has two more more operating positions which corresponds to the respective ribbons and one of which is selected as a predetermined initial position in which the ribbon holder is placed upon initialization of the printer. The operating positions are spaced from each other in a direction perpendicular to the line of printing. In each operating position of the ribbon holder, the active portion or length of the corresponding ribbon is aligned with a line of printing for printing or erasure.

In some printers, the ribbon holder has a plurality of operating positions which include at least one position corresponding to at least one ribbon, and at least one dummy position which does not correspond to any ribbon. A dummy position may be used as the predetermined initial position, so that the ribbon holder is initially placed in the dummy position in which none of the ribbon or ribbons is aligned with the line of printing. With the ribbon holder placed in the dummy position, a portion of the recording medium along the line of printing is visible.

In such printer, the print head is also initialized, namely, moved along the line of printing to a predetermined zero position, which is generally one of opposite extreme ends of a movement range of the print head over which the print head is reciprocable by a suitable feeding device.

An example of such printer in which the print head is initially returned to the zero position while the ribbon holder is brought to the predetermined initial position is disclosed in JP-A-63-165177. In this printer, the print head is reciprocable along a line of printing parallel to a platen, between left and right ends of a predetermined movement range, by a head feeding motor, so that printing is effected by the print head via a currently selected printing ribbon on a recording medium, over a predetermined printing range within the movement range. A desired one of two or more ribbons supported by the ribbon holder is selected by activating a motor of a ribbon selecting device to move the ribbon holder to a position corresponding to the desired ribbon, so that the active portion of the desired ribbon is aligned with the line of printing and located between the print head and the platen.

The printer disclosed in the above-identified publication includes a sensor which generates first and second signals when the printer is placed in respective first and second states. The first state is a state in which the print head is not located at the zero position (left or right end of the movement range), while the ribbon holder is placed in the predetermined initial position. The second state is a state in which the print head is located at the zero position, or a state in which the print head is not located at the zero position while the ribbon holder is not placed in the initial position.

The printer further includes initializing means for moving the print head to the zero position and bringing the ribbon holder to the predetermined initial position. If the first signal is initially generated by the sensor, the initializing means determines that the print head is not located at the zero position while the ribbon holder is placed in the initial position, and therefore commands the head feeding motor to return the print head to the zero position. When the second signal is generated by the sensor, the initializing means determines that the print head has been returned to the zero position with the ribbon holder held in the initial position, and terminates an initializing operation.

If the second signal is initially generated by the sensor, the initializing means determines that the print head is located at the zero position (pending the currently selected position of the ribbon holder), or that the print head is not located at the zero position while the ribbon holder is not placed in the initial position. In this case, the initializing means commands the head feeding motor to move the print head from either the zero position or a position other than the zero position, in a direction away from the zero position. If the second signal remains even after the head feeding motor has been commanded to move the print head in the direction away from the zero position, the initializing means determines that the ribbon holder is not placed in the initial position pending whether the print head is located at the zero position or not, and then commands the ribbon selecting motor to move the ribbon holder from the currently selected position to another. When the second signal is changed to the first signal, the initializing means determines that the ribbon holder is brought to the initial position, and then command the head feeding motor to move the print head to the zero position. When the first signal is then changed to the second signal, the initializing means confirms that the print head has been returned to the zero position, and terminates the initializing operation.

If the second signal is changed to the first signal, the initializing means determines that the ribbon holder is placed in the initial position, and commands the head feeding motor to move the print head to the zero position. When the first signal is then changed to the second signal, the initializing means confirms that the print head has been moved to the zero position, and terminates the initializing operation.

In the printer constructed as described above, the sensor should be designed so that the output signal of the sensor changes depending upon the currently selected position of the ribbon holder even when the print head is located at a position other than the zero position. That is, the sensor should be capable of detecting the position of the ribbon holder even when the print head is not located at the zero position. This requirement results in a complicated arrangement of the sensor.

The above requirement also leads to a problem explained below.

Generally, a sensor includes a first sensed portion which is moved with the print head, a second sensed portion which is moved with the ribbon holder, and a sensing portion for electrically detecting a movement or displacement of the first and second sensed portions and generating an output signal depending upon the detected movement of the sensed portions. The sensing portion is connected to a controller of the printer by a signal line to feed the output signal to the controller. For the sensing portion to be able to detect the currently selected position of the ribbon holder even when the print head is not located at the zero position, the sensing portion is usually attached to a movable member which is moved with the print head. On the other hand, a print head assembly including the print head and such movable member carrying the sensing portion of the sensor is preferably small-sized and light-weight, for increased feeding speed of the print head (increased printing speed) and improved printing efficiency.

In the known printer described above, the sensing portion of the sensor incorporated in the print head assembly inevitably increases the size and weight of the print head assembly, contrary to the above requirement for minimum size and weight for improved printing efficiency. Further, the attachment of the sensing portion of the sensor to the print head assembly leads to reduced efficiency in assembling the print head assembly. This is particularly so, because of a relatively long signal line extending between the sensing portion and a controller. Further, the long signal line pushes up the cost of the sensor, and may lead to reduced resistance of the controller to noises.

SUMMARY OF THE INVENTION

It is therefore an object of the present invention to provide a printing apparatus which is simple in construction and economical to manufacture and which assures high reliability of initializing operation to move the print head to the zero position and bring the ribbon holder to the predetermined initial position.

The above object may be attained according to a first aspect of the present invention, which provides a printing apparatus having (a) a platen for supporting a recording medium, (b) a print head for printing on the recording medium within a printing range along a line of printing parallel to the platen, the print head being reciprocable along the line of printing, within a predetermined movement range including the printing range, (c) a head feeding motor for moving the print head along the line of printing selectively in a first direction toward a zero position selected within the movement range and outside the printing range, and a second direction away from the zero position, (d) a ribbon holder for supporting at least one ribbon such that an active portion of each ribbon is used between the print head and the platen, (e) a support mechanism for supporting the ribbon holder such that the ribbon holder is reciprocable with the print head along the line of printing and has a plurality of operating positions which are spaced from each other in a direction intersecting the line of printing, the operating positions including a predetermined initial position in which the ribbon holder is placed upon initialization of the printing apparatus, and (f) a position selecting device including an actuator for placing the ribbon holder selectively in one of the operating positions, the printing apparatus comprising: (i) a zero position sensor generating a zero-position signal when the print head is placed in the zero position, and a non-zero-position signal when the print head is spaced apart from the zero position; (ii) a print head locking mechanism for permitting a movement of the print head from the zero position in the second direction when the ribbon holder is placed in the predetermined initial position, and inhibiting the movement of the print head from the zero position in the second direction when the ribbon holder is not placed in the initial position; and (iii) ribbon holder initializing means for effecting a ribbon initializing operation to place the ribbon holder in the initial position, the ribbon holder initializing means: applying to the head feeding motor a first zero return signal commanding the feeding motor to operate to move the print head in the first direction to the zero position; applying to the feeding motor a first off-zero movement signal commanding the feeding motor to move in the second direction to a predetermined position spaced from the zero position in the second direction; and if the zero-position signal remains after the first off-zero movement signal is applied to the feeding motor, commanding the position selecting device to operate to move the ribbon holder from a currently selected one of the operating positions to another.

In the present printing apparatus of the present invention constructed as described above, the print head locking mechanism permits the print head to move away from the zero position toward the printing range only when the print head is located at the zero position while the ribbon holder is placed in the predetermined initial position. In other words, the locking mechanism inhibits a movement of the print head away from the zero position when the ribbon holder is not placed in the initial position. Accordingly, when the ribbon holder is not placed in the initial position, the print head is not moved to a predetermined position by the head feeding motor even if the head feeding motor is operated in response to an off-zero movement signal, and the zero position sensor remains to generate the zero-position signal even after the head feeding motor has been operated according to the off-zero movement signal. Therefore, the ribbon holder initializing means is capable of checking whether the ribbon holder is placed in the initial position or not, by first applying to the head feeding motor the zero return signal commanding the feeding motor to operate to move the print head to the zero position, then applying to the feeding motor the off-zero movement signal commanding the feeding motor to operate to move the print head away from the zero position to the predetermined position, and checking if the zero-position signal is changed to the non-zero-position signal as a result of an actual movement of the print head according to the off-zero movement signal. If the non-zero-position signal is generated after the off-zero movement signal is applied to the head feeding motor, this means that the print head has been actually moved from the zero position to the predetermined position, which in turn means that the ribbon holder was placed in the initial position. In this case, it is not necessary to activate the position selecting device to bring the ribbon holder to the predetermined initial position.

If the zero position sensor remains to generate the zero-position signal even after the off-zero movement signal is applied to the head feeding motor, this means that the print head has not been moved away from the zero position, which in turn means that the ribbon holder was not placed in the initial position. In this case, the ribbon initializing means commands the position selecting device to operate to move the ribbon holder from the currently selected position to another. Where the ribbon holder has only two operating positions, the ribbon holder is brought to the initial position by activating once the position selecting device.

Thus, the use of the single zero position sensor makes it possible to detect the zero position of the print head and the currently selected position of the ribbon holder, namely, whether the print head is located at the zero position with the ribbon holder held in its initial position, or not. Described more precisely, the single zero position sensor cooperates with the print head locking mechanism to provide a comparatively simple arrangement for initializing the print head and the ribbon holder, that is, for bringing the print head to the zero position and placing the ribbon holder in the predetermined initial position.

Where the ribbon holder supports three or more operating positions at least one of which corresponds to one or more ribbons, the ribbon holder may be brought to its initial position by activating the position selecting device only once or two or more times. In this case, the ribbon initializing means determines whether the non-zero-position signal is generated after another off-zero movement signal is applied to the head feeding motor, namely, if the ribbon holder has been brought to the initial position by operation of the position selecting device. If the zero-position signal still remains, then the position selecting device is again operated to change the position of the ribbon holder from the present position to another position, which may or may not be the initial position. The above operation is repeated until the non-zero-position signal is generated after another off-zero movement signal is applied to the head feeding motor.

Where the ribbon holder has only two ribbons corresponding to respective ribbons, for example, the ribbon holder is normally brought to the initial position by actuating once the position selecting device. In this case, therefore, it is not necessary to apply another off-zero movement signal to the head feeding motor to confirm the generation of the non-zero-position signal and thereby confirm that the ribbon holder has been brought to the initial position. However, it is desirable to confirm the generation of the non-zero-position signal, because there is a possibility of any abnormality associated with the position selecting device.

The ribbon holder may support a single printing ribbon used for printing, a plurality of printing ribbons (of different colors, for example), or a plurality of ribbons which include one or more printing ribbons and a correction ribbon used for erasing printed images. In this case, the initial position of the ribbon holder 24 corresponds to the black ribbon, for example.

The operating positions of the ribbon holder include at least one position each corresponding to a ribbon. In other words, the operating positions of the ribbon holder include at least one dummy position each of which does not correspond to any ribbon. Such dummy position may be used as the predetermined initial position. In this case, the ribbon holder is initially placed in a dummy position in which the active portion of any ribbon is not aligned with the line of printing, so that a line of characters already printed on the recording medium is visible without being covered by any ribbon.

The operating positions of the ribbon holder are spaced from each other in a direction intersecting the line of printing, typically, in the direction substantially perpendicular to the line of printing. In other words, the support mechanism supports the ribbon holder such that the active portion of each ribbon is displaced in the direction intersecting or substantially perpendicular to the line of printing. For instance, the ribbon holder may be supported pivotally about an axis at an end portion thereof remote from the active portion of each ribbon supported, so that the active portion of the ribbon is movable in the direction perpendicular to the length of the active portion (which is parallel to the line of printing). Alternatively, the ribbon holder may be supported such that the entirety of the ribbon holder is movable in the direction perpendicular to the line of printing.

In one preferred form of the invention, the zero position sensor comprises: a movable portion which is reciprocated with the print head along the line of printing; and a stationary portion having a signal generator which is actuated by the movable portion to generate the zero-position signal when the print head is located at the zero position, the signal generator generating the non-zero-position signal when the print head is not located at the zero position. However, a movable portion which is reciprocated with the print head may have a signal generator activated by a stationary portion to generate the zero-position signal and non-zero-position signal.

The printing apparatus may take the form of an electronic typewriter having a housing, a keyboard portion provided in a front portion of the housing, and a printing portion which is disposed behind the keyboard portion and which includes the platen, the print head, the head feeding motor and the ribbon holder. The keyboard portion comprises a plurality of keys operated by an operator of the apparatus, and a matrix switch array including a plurality of switching elements. The switching element comprise operator-controlled switching elements which are opened and closed by the respective keys. According to one advantageous arrangement of the above form of the invention wherein the stationary portion of the zero position sensor has a signal generator, the switching elements further comprise a zero position sensing switching element as well as the operator-controlled switching elements, and the stationary portion of the zero position sensor comprises the zero position sensing switching element which operates as the signal generator, and a switch actuator which is disposed such that the switch actuator is operated by the movable portion to actuate the zero position sensing switching element when the print head is located at the zero position, so that the zero position sensing switching element generates the zero-position signal when the print head is located at the zero position.

In the above advantageous arrangement, the switch actuator may comprise a first arm portion engageable with the movable member when the print head is moved to the zero position, and a second arm portion engageable with the zero position sensing switching element when the first arm portion engages the movable member. The switch actuator is pivotally supported by the housing at an intermediate portion thereof from which the first and second arm portions extend, and the second arm portion is displaced for engagement with the zero position sensing switching element, as a result of a pivotal movement of the switch actuator upon engagement of the first arm portion with the movable member, whereby the zero position sensing switching element generating the zero-position signal when the print head is moved to the zero position.

According to one feature of the above arrangement wherein the switch actuator comprise the first and second arm portions as described above, the support mechanism is adapted to support the ribbon holder pivotally about a first pivot axis parallel to the line of printing along the platen, and the movable portion of the zero position sensor includes an arcuate portion provided on a member which is pivoted with the ribbon holder. This arcuate portion has an arcuate surface having an arc center on the first pivot axis of the ribbon holder. The switch actuator of the stationary portion of the zero position sensor is supported pivotally about a second pivot axis parallel to the line of printing. The first arm portion has a parallel surface near the zero position in the first direction and an inclined surface remote from the zero position in the second direction. The parallel and inclined surfaces are parallel and inclined to the line of printing, respectively and are contiguous to each other so as to form an angle larger than 180 degrees as measured outwardly of the parallel and inclined surfaces. The parallel and inclined surfaces are formed such that a line of force acting on the first arm portion and the arcuate surface of the arcuate portion is offset from the second pivot axis, and such that the arcuate portion first engages the inclined surface and then engages the parallel surface to thereby pivot the switch actuator about the second pivot axis as the arcuate portion is moved with the print head toward the zero position. The switch actuator is inhibited from pivoting by a pivotal movement of the ribbon holder about the first pivot axis.

However, the ribbon support mechanism may be adapted to support the ribbon holder such that the ribbon holder is displaceable in the direction in which the generally straight active portions of the ribbons are spaced from each other, rather than pivotable about an axis as indicated above.

Similarly, the switch actuator may be adapted to be displaced in a direction perpendicular to the line of printing, toward and away from the platen.

In another preferred form of this invention, the said print head locking mechanism comprises a first and a second engaging member which are displaceable relative to each other and which are engageable with and disengageable from each other. One of the first and second engaging members is provided on a stationary member of the apparatus, while the other of the first and second engaging members is provied on a movable member which is reciprocated with the print head. The first and second engaging members move toward each other as the print head is moved toward said zero point, and engaging each other to inhibit a movement of the print head away from the zero position when the ribbon holder is not placed in the initial position. The first and second engaging members are spaced apart from each other to permit a movement of the print head away from the zero position when the ribbon holder is placed in the initial position.

In one advantageous arrangement of the above preferred form of the invention, the above-indicated one of the first and second engaging members has a hole, while the other engaging member has a projection which is engageable with the hole when the first and second engaging members are moved relative to each other in a direction intersecting the line of printing. In this instance, at least one of the first and second engaging members includes yielding means which permits the hole and the projection to move away from each other in the direction intersecting the line of printing. Further, at least one of the projection and a portion defining the hole has an inclined surface which is inclinded with respect to the line of printing. The inclined surface is engageable with the other of the projection and the portion defining the hole, when the print head is moved to the zero position in the first direction defined above while the ribbon holder is not placed in the initial position. The inclined surface cooperates with the yielding means to permit the projection to be inserted into the hole when the print head is moved to the position while the ribbon holder is not placed in the initial position.

In the above arrangement, the engaging member having the hole is stationary in the direction parallel to the line of printing while the engaging member having the projection is movable with the print head in the direction parallel to the line of printing. In this respect, it is noted that the engaging member having the hole is movable in the direction perpendicular to the line of printing, while the engaging member having the projection is stationary in the direction perpendicular to the line of printing.

The object indicated above may also be attained according to a second aspect of this invention, which provides a printing apparatus having (a) a platen for supporting a recording medium, (b) a print head for printing on the recording medium within a printing range along a line of printing parallel to the platen, the print head being reciprocable along the line of printing, within a predetermined movement range including the printing range, (c) a head feeding motor for moving the print head along the line of printing selectively in a first direction toward a zero position selected within the movement range and outside the printing range, and a second direction away from the zero position, (d) a ribbon holder for supporting at least one ribbon such that an active portion of each ribbon is used between the print head and the platen, (e) a support mechanism for supporting the ribbon holder such that the ribbon holder is reciprocable with the print head along the line of printing and has a plurality of operating positions which are spaced from each other in a direction intersecting the line of printing, the operating positions including a predetermined initial position in which the ribbon holder is placed upon initialization of the printing apparatus, and (f) a position selecting device including an actuator for placing the ribbon holder selectively in one of the operating positions, the printing apparatus comprising: (i) a zero position sensor generating a zero-position signal when the print head is placed in the zero position, and a non-zero-position signal when the print head is spaced apart from the zero position; (ii) a print head locking mechanism for permitting a movement of the print head from the zero position in the second direction when the ribbon holder is placed in the predetermined initial position, and inhibiting the movement of the print head from the zero position in the second direction when the ribbon holder is not placed in the initial position; and (iii) initializing means for effecting a print head and ribbon initializing operation to move the print head to the zero position and to place the ribbon holder in the initial position, the initializing means: applying to the head feeding motor a first zero return signal commanding the feeding motor to operate to move the print head in the first direction to the zero position; applying to the feeding motor a first off-zero movement signal commanding the feeding motor to move in the second direction to a predetermined position spaced from the zero position in the second direction; and if the zero-position signal remains after the first off-zero movement signal is applied to the feeding motor, repeating a ribbon initializing operation including commanding the position selecting device to operate to move the ribbon holder from a currently selected one of the plurality of operating positions to another, applying to the feeding motor another off-zero movement signal, determining whether the non-zero-position signal is generated after the above-indicated another off-zero movement signal is applied to the head feeding motor, and if the zero-position remains after the above-indicated another off-zero movement signal is applied to the head feeding motor, applying to the head feeding motor a second zero return signal commanding again the head feeding motor to operate to move the print head to the zero position, the initializing means repeating the ribbon initializing operation until the non-zero-position signal is generated as a result of a movement of the print head according to the above-indicated another off-zero movement signal, the initializing means terminating the print head and ribbon initializing operation when the non-zero-position signal is generated after the above-indicated another off-zero movement signal is applied to the head feeding motor, and wherein the initiating means terminates the print head and ribbon initializing operation if the non-zero-position signal is generated after the first off-zero movement signal is applied to the head feeding motor.

The printing apparatus constructed according to the second aspect of the invention has substantially the same advantages as described above with respect to the first aspect of the invention. Further, the ribbon initializing operation indicated above is repeated until the non-zero-position signal is generated as a result of an actual movement of the print head according to another off-zero movement signal. Namely, the print head and ribbon initializing means is adapted to apply to the head feeding motor an off-zero movement signal each time the position selecting device is actuated to change the position of ribbon holder, to thereby confirm that the ribbon holder has been brought to the initial position. If the non-zero position signal is generated after the first off-zero signal is applied to the head feeding motor, this means that the ribbon holder has been already placed in the initial position when the print head is returned to the zero position. In this case, the print head and ribbon initializing operation is terminated as soon as the generation of the non-zero-position signal has been confirmed after the application of the first off-zero movement signal (after the actual movement of the print head to the predetermined position according to the first off-zero signal).

The printing apparatus according to the above-described second aspect of the invention is preferrably arranged such that one of a left end and a right end of the movement range of the print head is selected as a machine zero point, and the print head has a printing zero position in the vicinity of one of a left end and a right end of the printing range, which one end is nearer to the machine zero point than the other end. In this case, the zero position sensor is adapted to geneate the zero-position signal when the print head is located within a non-printing range which is within the movement range and outside the printing range, one of opposite ends of the non-printing range being defined by the machine zero point. The non-zero-position signal is generated when the print head is located outside the non-printing range. Further, the print head locking mechanism is adapted to permit the print head to move in a direction from the non-printing range toward the printing range when the print ribbon holder is placed in the predetermined initial position, and inhibit the print head from moving in the direction from the non-printing range toward the printing range.

According to one advantageous arrangement of the above preferred form of the apparatus, the initializing means comprises: means for commanding the head feeding motor to operate to move the print head in a direction from the printing range toward the non-printing range until the zero-position signal is generated; means commanding the head feeding motor to operate to move the print head in the direction from the non-printing range toward the printing range to the print start point; means operable when the zero-position signal remains after the head feeding motor is commanded to move the print head to the printing zero position, for first commanding the head feeding motor to operate to move the print head to the machine zero position, then commanding the position selecting device to operate to change the position of the ribbon holder, then commanding the head feeding motor to operate to move the print head to the printing zero position, determining whether the zero-position signal is changed from the non-zero-position signal, and terminating the ribbon initializing operation and a print head initializing operation to move the print head to the printing zero position when the zero-position signal is changed to the non-zero position signal; and means operable when the zero-position signal is changed to the non-zero-position signal after head feeding motor is first commanded to operate to move the print head to the machine zero position, for terminating the ribbon initializing operation and the print head initializing operation.

BRIEF DESCRIPTION OF THE DRAWINGS

The above and optional objects, features and advantages of this invention will become more apparent by reading the following detailed description of a presently preferred embodiment of the invention, when considered in connection with the accompanying drawings, in which:

FIG. 4 is an elevational view partly in cross section showing a ribbon holder, a ribbon support mechanism and a ribbon selecting device for pivoting the ribbon holder;

FIG. 5 is an elevational view partly in cross section showing the ribbon selecting device;

FIG. 6 is an elevational view partly in cross section showing a cam mechanism provided in the ribbon selecting device of FIG. 5;

DETAILED DESCRIPTION OF THE PREFERRED EMBODIMENT

Figure 1:
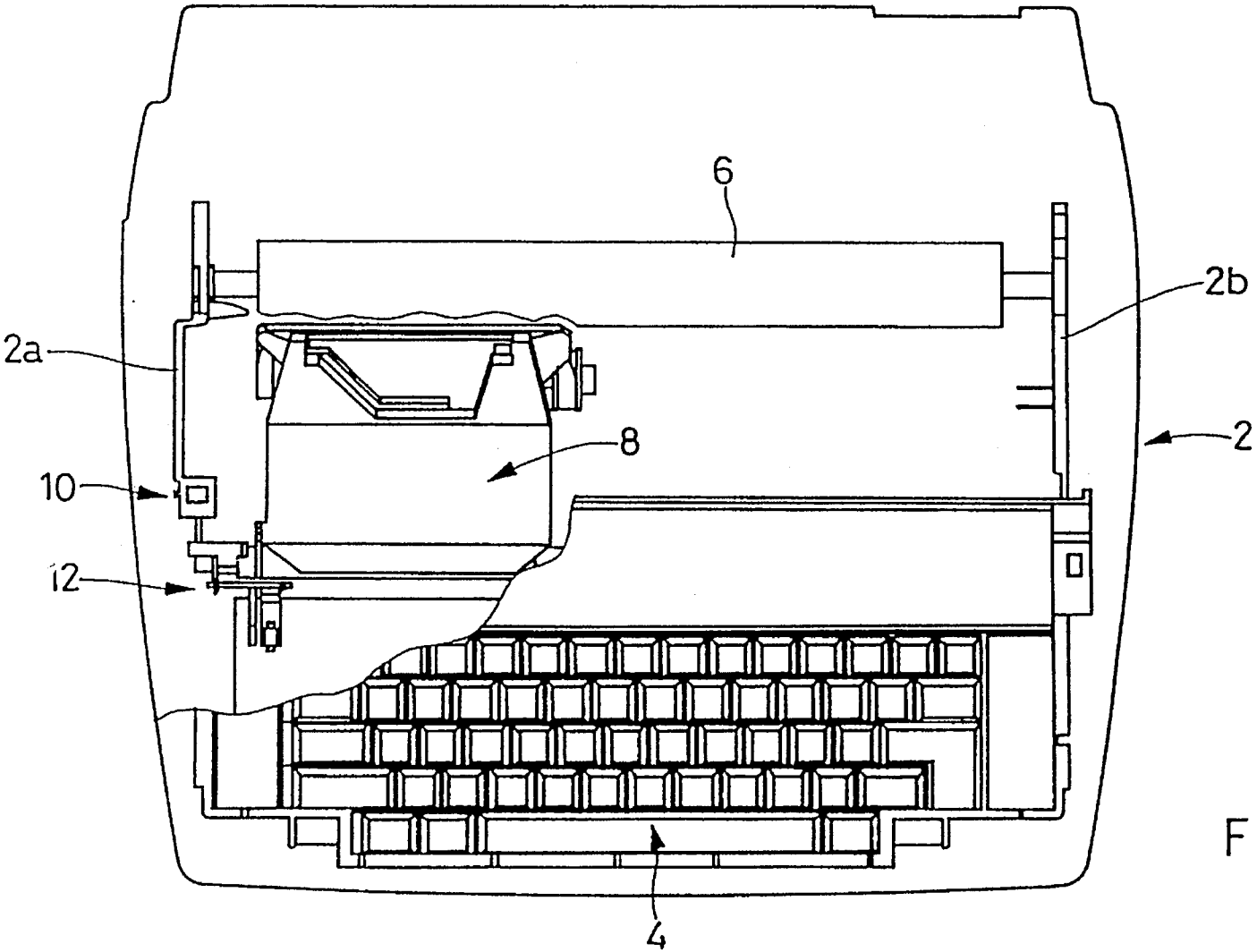
FIG. 1 is a schematic view showing a printing apparatus in the form of an electronic typewriter constructed according to one embodiment of the present invention.
Figure 3:
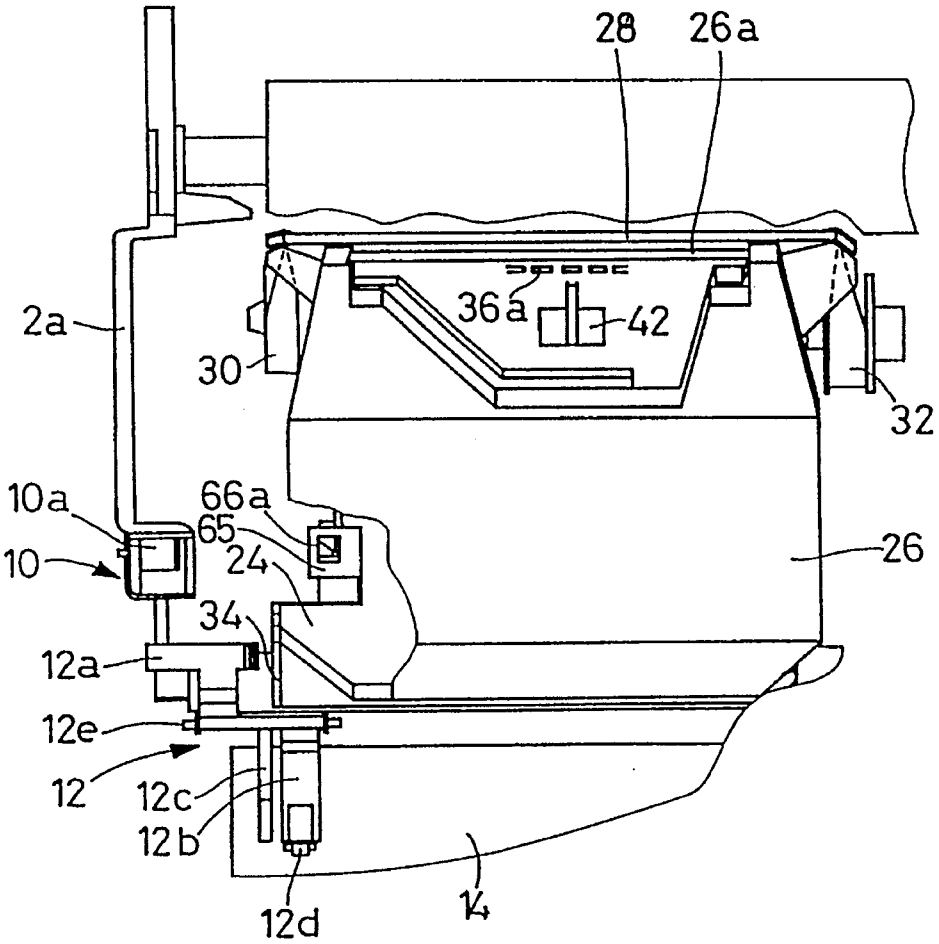
FIG. 3 is an enlarged left side elevational view of the typewriter of FIG. 1.
Figure 2:
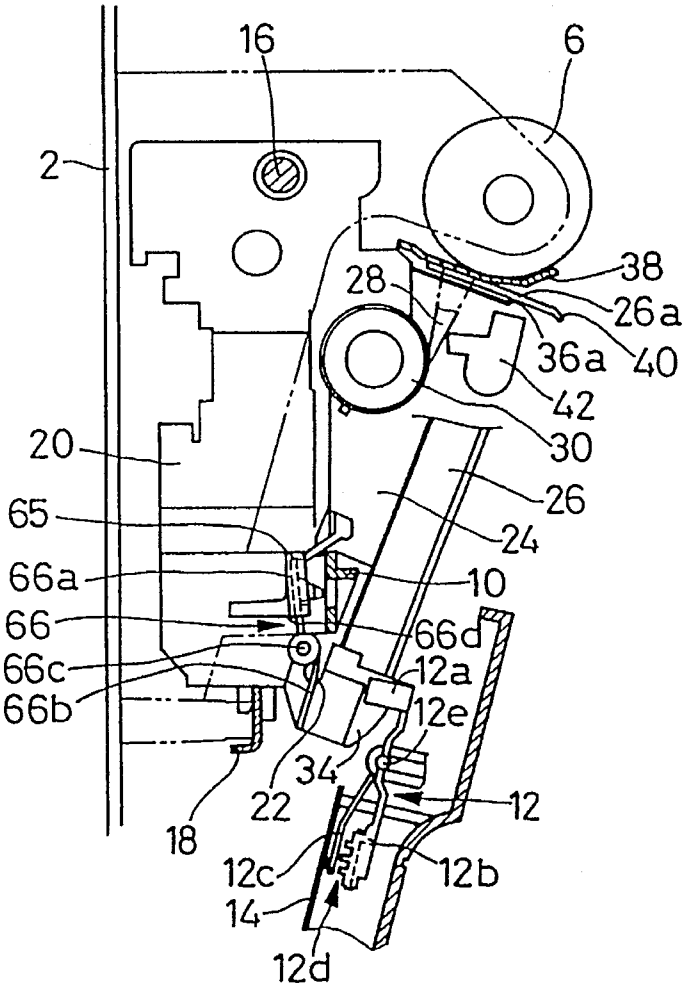
FIG. 2 is an enlarged plan view of a left-side end portion of the typewriter of FIG. 1, showing a print head of the typewriter located near a zero position.

Referring first to FIGS. 1, 2 and 3, the electronic typewriter has a housing 2, a keyboard 4 provided in a front portion of the housing 2, and a printing portion disposed behind the keyboard 4. The keyboard 4 has multiple keys operated by the operator of the typewriter for entering data such character data representative of letters, symbols and other characters, and function data indicative of various functions performed by the typewriter.

The printing portion includes a platen 6 for supporting a recording medium, a print head 8 for printing characters, graphical representations and other visible images on the recording medium according to entered print data, and a head feeding motor in the form of a stepping motor 7 (FIG. 13) for reciprocating the print head 8 along a line of printing on the recording medium parallel to the length of the platen 6.

Figure 13:
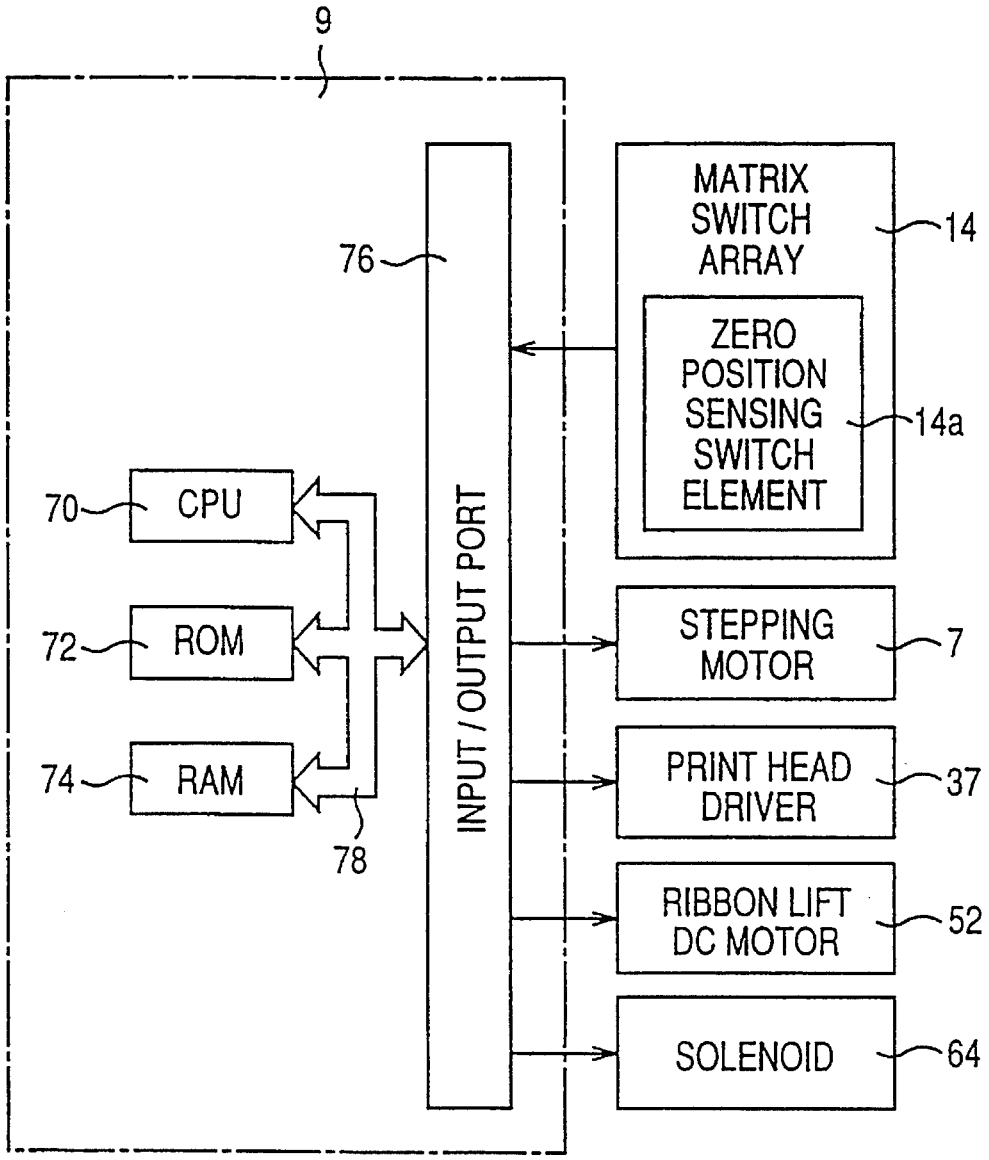
FIG. 13 is a block diagram showing a control system for the typewriter of FIG. 1.
Figure 14:
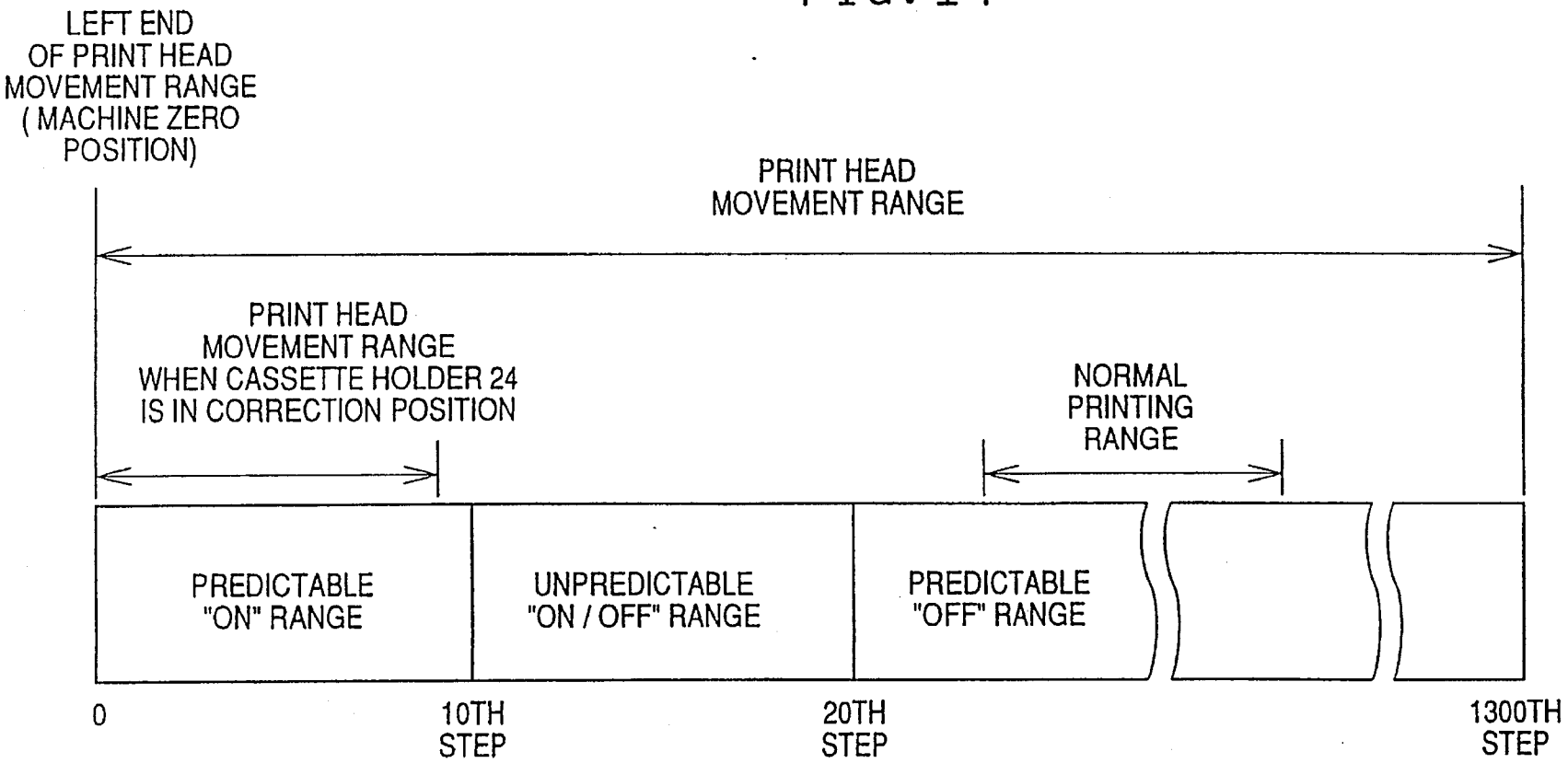
FIG. 14 is an illustration explaining a movement range and a printing range of the print head, in relation to the numbers of energization steps of a print head feeding stepping motor.

The present electronic typewriter is controlled by a control system illustrated in the block diagram of FIG. 13, which includes an electronic controller 9 for controlling the stepping motor 7 and an operation of the print head 8 as described below. The stepping motor 7 and the controller 9 are also housed in the housing 2. As also indicated in FIG. 13, the controller 9 is adapted to receive signals from a matrix switch array 14 which includes operator-controlled switching elements that are opened and closed depending upon operation of the keys on the keyboard 4. The matrix switch array 14 also includes a zero position sensing switching element 14*a*, which serves as a signal generator. This signal generator or switching element 14*a* cooperates with a switch actuator 12 and a pusher 34 (which will be described) to constitute a zero position sensor for detecting a zero position (machine zero position) of the print head 8 that is located at or near the left end of a movement range of the print head, as indicated in FIG. 14.

As shown in FIGS. 2 and 3, the print head 8 is provided on a carriage 20 which is movably supported by a guide shaft 16 and a guide rail 18 which are supported by the housing 2 and extend parallel to the platen 6. The print head 8 is reciprocable with the carriage 20 in the direction parallel to the platen 6 while being guided by the guide shaft and rail 16, 18, when the stepping motor 7 is operated under the control of the electronic controller 9. The movement range (FIG. 14) of the print head 8 (carriage 20) within which the print head 8 is reciprocable is defined by a left chassis 2*a* and a right chassis 2*b* at the left and right ends of the housing 2, as indicated in FIG. 1. Normally, however, the print head 8 is moved within a printing range, which is selected within the movement range, as indicated in FIG. 14. The zero position is located outside the normal printing range.

The carriage 20 also carries a ribbon holder 24 such that the ribbon holder 24 is pivotable about a shaft 22 parallel to the printing direction. The shaft 22 functions as a pivot axis of the ribbon holder 24. On the ribbon holder 24, there is removably mounted a ribbon cassette 26 which accommodates a printing ribbon 26*a* such that a portion of the ribbon 26*a* is exposed outside the cassette 26, so as to extend between the print head 8 and the platen 6 and along the length of the platen 6. Thus, the ribbon 26*a* always has a generally straight exposed portion ready for use for printing by the print head 8. The ribbon holder 24 also supports a correction ribbon 28, more precisely, a supply reel 30 having a roll of a fresh or unused length of the correction ribbon 28, and a take-up reel 32 having a roll of a used length of the correction ribbon 28. The supply and take-up reels 30, 32 are positioned on respective opposite side faces of the ribbon holder 24, as shown in FIG. 2. With these reels 30, 32 supported by the ribbon holder 24, a generally straight active portion of the correction ribbon 28 extends between the platen 6 and the print head 8, such that this straight active portion of the ribbon 28 is almost parallel to and located below the corresponding portion of the printing ribbon 26*a*. That is, the generally straight active portions of the ribbons 26*a*, 28 are spaced from each other in the direction perpendicular to the length of the platen 6, in a plane substantially parallel to the plane of a daisy-type print wheel 36 of the print head 8, as shown in FIG. 4.

The daisy-type print wheel 36 of the print head 8 has a multiplicity of radial arms which have respect font elements 36*a* corresponding to respective characters, as well known in the art. The print head 8 further includes: a paper guide 38 attached to the carriage 20, for holding the recording medium (sheet of paper) in contact with the surface of the platen 6; a ribbon guide 40 integral with the paper guide 38, for guiding the exposed portions of the printing ribbon 26*a* and the correction ribbon 28 in position between the platen 6 and the uppermost point on the circumference of the print wheel 36; a print hammer 42 (FIGS. 2 and 3) also fixed to the carriage 20, for striking the uppermost font element 36*a* against the surface of the recording medium via the ribbon 26*a* or 28, for printing or erasing the corresponding character; and a print head driver 37 (FIG. 13). The print head driver 37 includes a print wheel drive motor for rotating the print wheel 36 to bring a selected one of the font elements 36*a* to a printing position, namely, uppermost position of the wheel 36, and further includes a hammer drive motor for activating the print hammer 42. The print head driver 37 is controlled by the controller 9 according to the print data, so that printing is effected on the recording medium supported by the platen 6, via the active portion of the printing ribbon 26*a*. The printed character may be erased by hammering the same font element 36*a* against the printed character via the active portion of the correction ribbon 28.

The ribbon holder 24 has two operating positions corresponding to the printing and correction ribbons 26*a*, 28, more specifically, a lower position and an upper position. In the lower position of the ribbon holder 24, the active portion of the printing ribbon 26*a* is aligned with the line of printing between the platen 6 and the selected font element 36*a* at the uppermost position of the print wheel 36. In the upper position, the active portion of the correction ribbon 28 is aligned with the line of printing. In the present embodiment, the ribbon holder 24 is initially placed in the lower position. That is, the lower position is the predetermined initial position of the ribbon holder 24 which is selected upon initialization of the typewriter immediately after the typewriter is turned on, so that the print head 8 is ready for printing with the printing ribbon 26*a* immediately after the initialization. As described blow, the print head 8 is moved to the zero position upon initialization of the typewriter.

The ribbon holder 24 pivotally supported on the carriage 20 is moved to the lower position (initial position) or upper position by a position selecting device or ribbon selecting device as illustrated in FIGS. 4–6. The ribbon selecting device includes a ribbon lift cam 46 mounted on a cam shaft 44 provided on the carriage 20, as shown in FIG. 4. The ribbon lift cam 46 is rotatable relative to the cam shaft 44, by a ribbon lift DC motor 52 via a transmission mechanism as described below.

The ribbon lift cam 46 is a cylindrical member having a large-diameter portion which has a cam groove 48 formed in one side surface thereof. The cam groove 48 has a small-diameter portion 48*a* and a large-diameter portion 48*b* as indicated in FIGS. 4 and 6.

The ribbon holder 24 has a follower pin 50 extending therefrom for engagement with the cam groove 48 of the ribbon lift cam 46. When the following pin 50 is located in the small-diameter portion 48*a* of the groove 48, the ribbon holder 24 is placed in the lower position, namely, initial position in which the active portion of the printing ribbon 26*a* is aligned with the line of printing in front of the platen 6. When the following pin 50 is located in the large-diameter portion 48*b*, the ribbon holder 24 is placed in the upper position in which the active portion of the correction ribbon 28 is aligned with the line of printing.

On the cam shaft 44, there is also mounted a ribbon lift gear 56 which is connected to the DC motor 52 through gear gears 54*a* and 54*b*. The ribbon lift cam 46 and the ribbon lift gear 56 have respective small-diameter portions 46*a*, 56*a*, as shown in FIG. 6. A clutch spring 59 is wound on these small-diameter portions 46*a*, 56*a*, and a clutch collar 58 having a pair of protrusions 58*a* is fitted on the clutch spring 59 such that the clutch spring 59 is fixed at one end thereof to the clutch collar 59 and at the other end to the ribbon lift cam 46. These clutch collar 58 and clutch spring 59 constitute a clutch mechanism for transmitting a rotary motion of the ribbon lift gear 56 to the ribbon lift cam 46 when the rotation of the clutch collar 58 is permitted with the protrusions 58*a* being free from an armature arm 60.

When the ribbon lift gear 56 is rotated counterclockwise as indicated by arrow in FIG. 5 while the protrusions 58*a* of the clutch collar 58 are not engaged with the armature arm 60, the clutch spring 59 acts to connect the small-diameter portions 46*a*, 56*a* as a unit, and rotates with the ribbon lift gear 56, whereby the rotation of the gear 56 is transmitted to the ribbon lift cam 46. When the protrusions 58*a* are engaged with the armature arm 60 to inhibit the rotation of the clutch collar 58, the clutch spring 59 acts to loosen the small-diameter portions 46*a*, 56*a*, whereby the ribbon lift gear 56 is disconnected from the ribbon lift cam 46, whereby the rotation of the cam 46 is stopped.

The armature arm 60 is pivotally supported on the carriage 30, for engagement with the protrusions 58*a* of the clutch collar 58 to stop the rotation of the clutch collar 58. The armature arm 60 is biased by a spring 62 in a counterclockwise direction as seen in FIG. 5, so as to move the free end of the armature arm 60 to within a circle which is described by the protrusions 58*a* during rotation of the clutch collar 58. The ribbon selecting device also includes a solenoid 64 for pivoting the armature arm 60 in the clockwise direction against the biasing action of the spring 62, for disengaging the free end of the armature arm 60 from the protrusions 58*a*.

When the solenoid 64 is in the de-energized state, the free end of the armature arm 60 is held in engagement with the protrusions 58*a*, to stop the rotation of the clutch collar 58, whereby the rotation of the ribbon lift cam 46 is stopped even while the DC motor 52 is kept operated. When the solenoid 64 is energized, the armature arm 60 is pivoted away from the protrusions 58*a* against the biasing force of the spring 62, the clutch collar 58 is permitted to rotate with the ribbon lift gear 56, whereby the ribbon lift cam 46 is rotated.

The two protrusions 58*a* correspond to the lower position (initial position) and upper position of the ribbon holder 24. That is, when the armature arm 60 is engaged with one of the protrusions 58*a*, the ribbon holder 24 is held in the lower or initial position for using the printing ribbon 26*a*. When the armature arm 60 is engaged with the other protrusion 58*a*, the ribbon holder 24 is held in the upper position for using the correction ribbon 28.

Referring back to FIGS. 2 and 3 and further to FIG. 7, there will be described the zero position sensor which includes the zero position sensing switching element 14*a* of the matrix switch array 14, switch actuator 12 and pusher 34. As shown in FIGS. 2 and 3, the switch actuator 12 is located at the left end portion of the housing 2, near the left chassis 2*a*, such that one end of the actuator 12 is aligned with the zero position sensing switching element 14*a* which is disposed at the left end of the matrix switch array 14 in the lower part of the keyboard 4.

Figure 7:
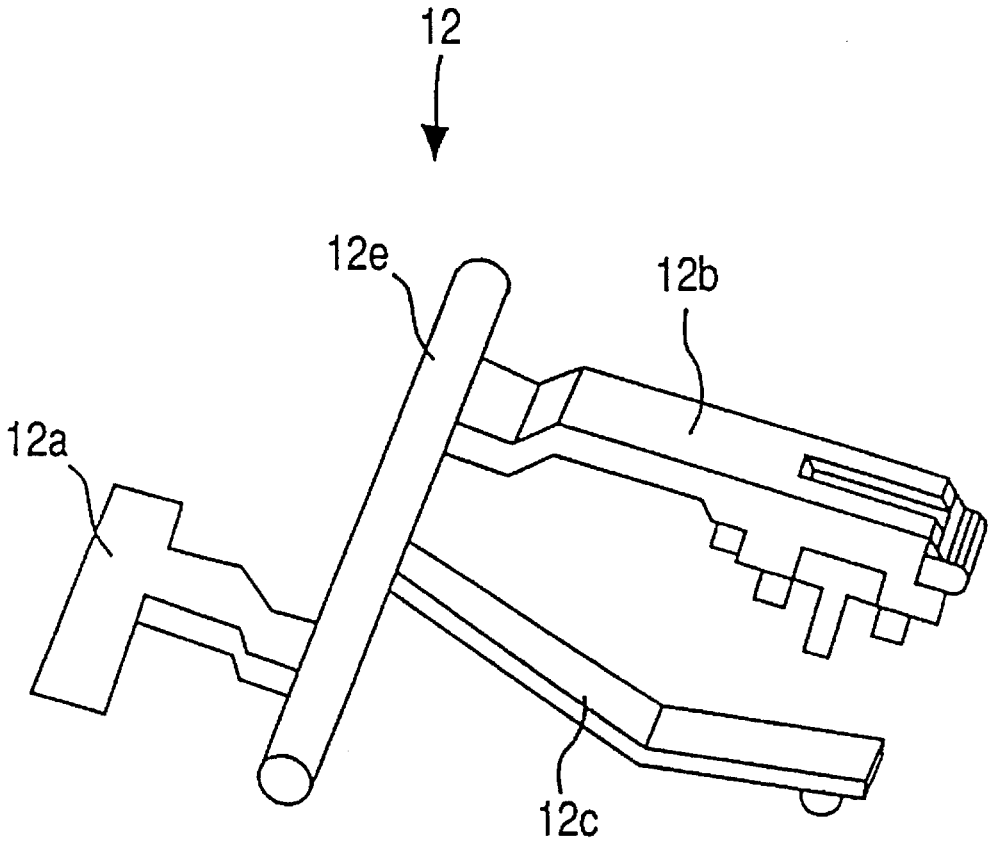
FIG. 7 is a perspective view of a switch actuator of a zero position sensor for detecting the zero position of the print head.

As most clearly shown in FIG. 7, the switch actuator 12 has: a pivot axis in the form of a shaft 12*e* parallel to the line of printing along the platen 6; a first arm portion in the form of a contact arm 12*a* which is fixed to the shaft 12*e* so as to extend in a direction perpendicular to the shaft 12*e* and in a direction away from the switching element 14*a*; a second arm portion in the form of a contactor arm 12*b* which is fixed to the shaft 12*e* so as to extend in parallel to the contact arm 12*a* and in a direction toward the switching element 14*a*; and a sheet spring 12*c* fixed to the shaft 12*e* so as to extend in parallel to the contactor arm 12*b* and in the direction toward the matrix switch array 14. The contact arm 12*a*, contactor arm 12*b* and sheet spring 12*c* are spaced from each other in the axial direction of the shaft 12*e* such that the fixed end of the sheet spring 12*c* is interposed between the fixed ends of the contact and contactor arms 12*a*, 12*b*. Further, the contactor arm 12*b* and the sheet spring 12*c* are spaced from each other by a given angle about the axis of the shaft 12*e*, so that the contactor arm 12*b* is normally held apart from the switching element 14*a*, with the sheet spring 12*c* held in contact with the frame of the matrix switch array 14.

The free end of the contact arm 12*a* is positioned on a path of movement of the pusher 34 attached to the left side surface of the ribbon holder 24 such that the pusher 34 is engageable with the free end of the contact arm 12*a*, to push up the contact arm 12*a* and thereby pivot the switch actuator 12 clockwise (in FIGS. 3 and 7) against the biasing action of the sheet spring 12*c*, so that a contactor rubber 12*d* (FIG. 3) provided at the free end of the contactor arm 12*b* comes into contact with the switching element 14*a*, to thereby closing the switching element 14*a*, when the print head 8 is moved to the machine zero position at the left end of the movement range. The switching element 14*a* generates a zero-position signal (ON signal) indicating that the print head 8 is placed in the zero position, when the switching element 14*a* is closed by the contactor arm 12*b* with the clockwise pivotal movement of the switch actuator 12 as a result of contact of the contact arm 12*a* with the pusher 34 in the process of movement of the print head B toward the zero position. When the switching element 14*a* is open, the switching element generates a non-zero-position signal (OFF signal) indicating that the print head 8 is not placed in the zero position.

The pusher 34 is an arcuate portion having an arcuate or part-cylindrical surface which has an arc center on the axis of the shaft 22 about which the ribbon holder 24 is pivoted. The arcuate surface of the pusher 34 assures a predetermined constant amount of displacement of the free end of the contact arm 12*a* by the pusher 34, irrespective of whether the ribbon holder 24 is placed in its lower position (predetermined initial position) or upper position. In other words, the switching element 14*a* is closed when the print head 8 is located at the zero position, without regard to the currently selected position of the ribbon holder 24.

Figure 8:
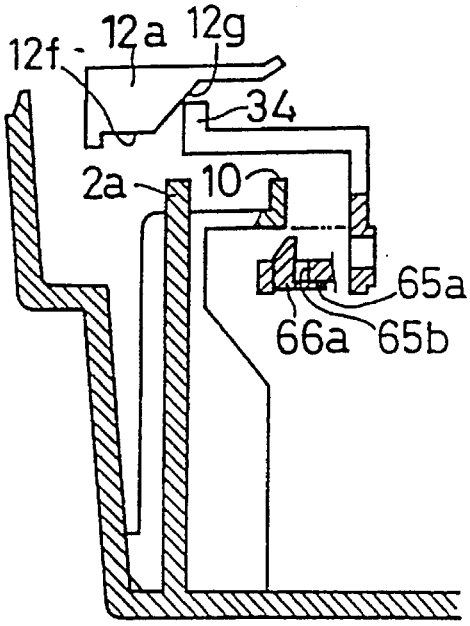
FIGS. 8 and 9 are views indicating a positional relationship between the switch actuator of FIG. 7, a pusher engageable with the switch actuator, and a positional relationship between a print head locking member and an engaging portion of the typewriter housing engageable with the locking member.
Figure 9:
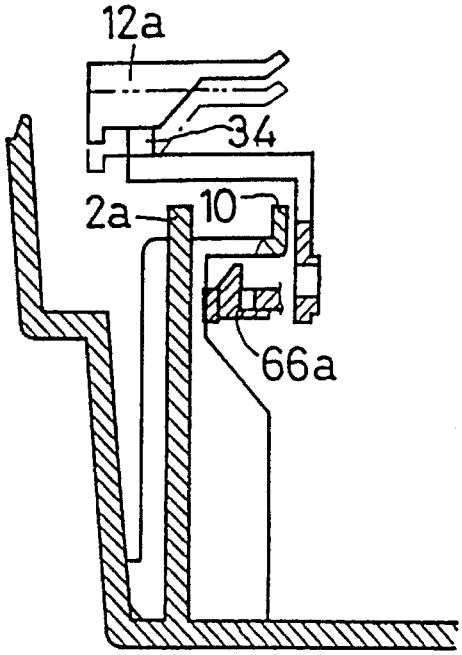

As shown in FIGS. 8 and 9, the free end portion of the contact arm 12*a* has a parallel surface 12*f* near the zero position of the print head 8, and an inclined surface 12*g* remote from the zero position in the direction parallel to the line of printing. The parallel and inclined surfaces 12*f*, 12*g* are contiguous to each other. The parallel surface 12*f* is parallel to the line of printing, and the inclined surface 12*g* is inclined relative to the parallel surface 12*f* so that the parallel and inclined surfaces 12*f*, 12*g* form an angle larger than 180 degrees outwardly of the surfaces 12*f*, 12*g*. The parallel and inclined surfaces are formed such that a line of force acting on the free end portion of the contact arm 12*a* and the arcuate surface of the pusher 34 is offset from the axis of the shaft 12*e*.

When the print head 8 is moved toward the zero position, the pusher 34 first engages the inclined surface 12*g* as indicated in FIG. 8, and then engages the parallel surface 12*f* as indicated in FIG. 9, to thereby pushes the free end of the contact arm 12*a* and thus pivot the switch actuator 12 about the shaft 12*e* clockwise (in FIG. 2) against the biasing force of the sheet spring 12*c*. As a result, the switching element 14*a* is pressed by the contactor rubber 12*d* at the free end of the contactor arm 12*b*, and is thus closed or turned ON to generate the zero-position or ON signal. However, the switch actuator 12 is inhibited from pivoting by a pivotal movement of the ribbon holder 24 about the shaft 22.

It is noted that a range of movement of the print head 8 within which the zero position sensing switching element 14*a* is closed or turned ON inevitably fluctuates and is not predictable, as indicated in FIG. 14 and as explained below in detail. While the extreme left end of the overall movement range of the print head is referred to as "machine zero position" or "zero position of the print head 8", the zero position may be considered to be a position at which the switching element 14*a* is turned ON (zero-position signal is generated). This aspect has some relation with a print head locking mechanism described below.

Referring back again to FIGS. 2 and 3 and further to FIG. 10, there will be described the print head locking mechanism adapted to inhibit a rightward movement of the print head 8 from the zero position when the ribbon holder 24 is placed in the upper position (for the correction ribbon 28), namely, not in the predetermined initial position (lower position for the printing ribbon 26*a*).

The print head locking mechanism includes: a stationary engaging member in the form of an engaging portion 10 of the left chassis 2*a* of the housing 2; a lock control member 65 fixed to the ribbon holder 24 so that the lock control member 65 is displaced with a pivotal movement of the ribbon holder 24; and a movable engaging member in the form of a print head locking member 66 provided on the carriage 20. The engaging portion 10 on the left chassis 2*a* has a hole 10*a* formed so as to extend in the direction perpendicular to the axis of the platen 6, as shown in FIGS. 3 and 10. The print head locking member 66 includes: a shaft 66*c* rotatably supported by the carriage 20; an elastic arm 66*b* which extends from the shaft 66*c* and which is held in contact with the underside of the ribbon holder 24; and an engaging arm 66*d* extending from the shaft 66*e* in a direction opposite to the direction in which the elastic arm 66*b* extends.

The shaft 66*c* of the locking member 66 is parallel to the line of printing or axis of the platen 6. The engaging arm 66*d* extends toward the platen 6 and has a projection 66*a* which extends in the direction perpendicular to the axis of the shaft 66*c*. The projection 66*a* is engageable with the hole 10*a* as a result of a pivotal movement of the locking member 66 about the shaft 66*c* when the print head 8 is placed in the zero position while the ribbon holder 24 is placed in the upper position, as described below in detail.

The locking member 66 is an integrally formed structure made of a synthetic resin, and the engaging arm 66*d* as well as the elastic arm 66*b* has a certain degree of elasticity and function as yielding means. As shown in FIG. 10, the projection 66*a* has an inclined surface 66*e* which is engageable with the engaging portion 10 when the print head 8 is moved to the zero position.

Figure 10:
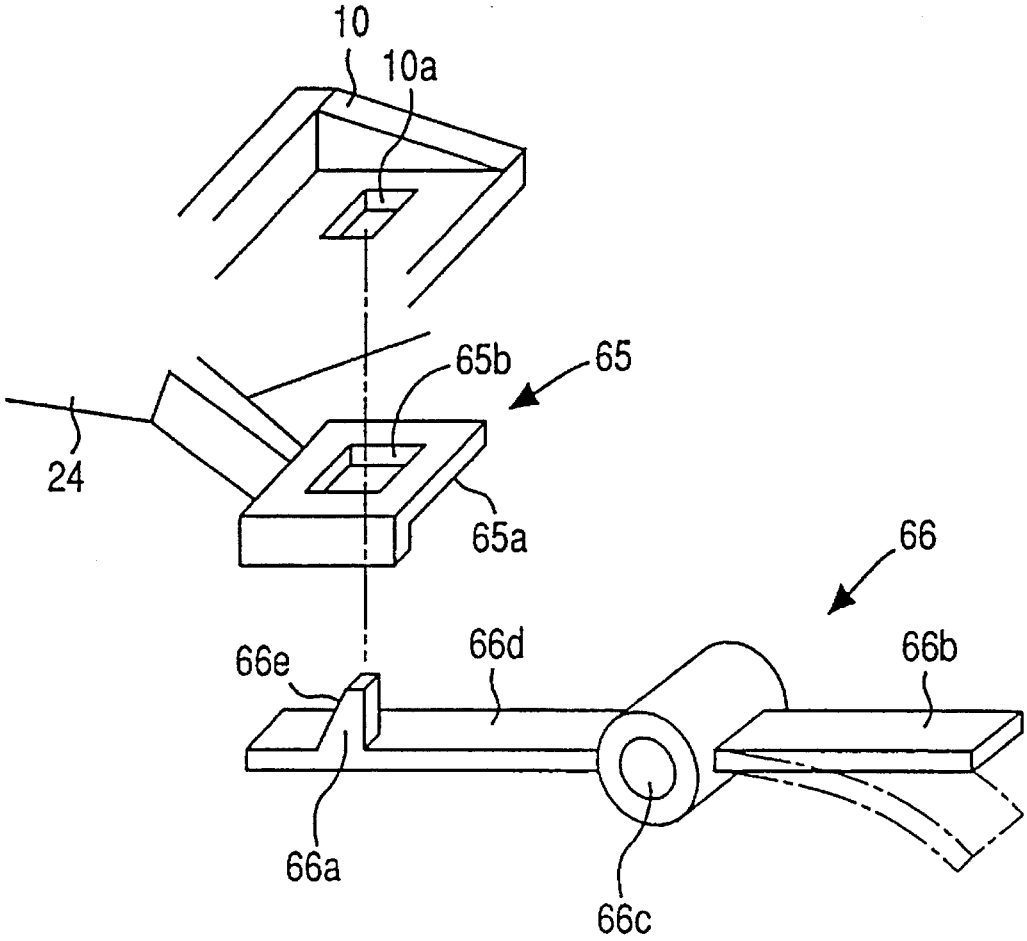
FIG. 10 is a perspective view depicting a positional relationship among the engaging portion of the typewriter, the carriage locking member, and a lock control member attached to the ribbon holder.

As shown in FIG. 10, the lock control member 65 attached to the ribbon holder 24 has a lower surface 65*a* and a hole 65*b*. The lock control member 65 and the locking member 66 are positioned relative to each other such that the projection 66*a* extends through the hole 65*b* while a portion of the engaging arm 66*d* near the projection 66*a* is held in contact with the lower surface 65*a* of the lock control member 65, under the biasing action of the arms 66*b*, 66*d*, as indicated in FIGS. 8, 9, 11 and 12. When the ribbon holder 24 is placed in the lower position (initial position) for the printing ribbon 26*a*, the lock control member 65 holds the projection 66 apart from the engaging portion 10 against the biasing force of the elastic arm 66*b*, thereby preventing the projection 66*a* from being inserted into the hole 10*a* even when the print head 8 is located at the zero position, as indicated in FIGS. 8 and 9.

When the ribbon holder 24 is moved from the lower position to the upper position for the correction ribbon 28, the lock control member 65 is accordingly moved up, thereby permitting the locking member 66 to pivot about the shaft 66*c* in the clockwise direction (as seen in FIG. 10) under the biasing force of the arms 66*b*, 66*d*. Therefore, the projection 66*a* extends into the hole 10*a* if the print head 8 is located at the zero position. When the print head 8 is located away from the zero position and when the ribbon holder 24 is placed in the upper position, the projection 66*a* can be inserted into the hole 10*a* as the print head 8 is moved toward the zero position, such that the inclined surface 66*e* of the projection 10*a* contacts the engaging portion 10 defining the hole 10*a*, and the free end portion of the engaging arm 66*d* of the locking member 66 is pressed down by the engaging portion 10 during sliding contact of the inclined surface 66*e* with the engaging portion 10.

Figure 11:
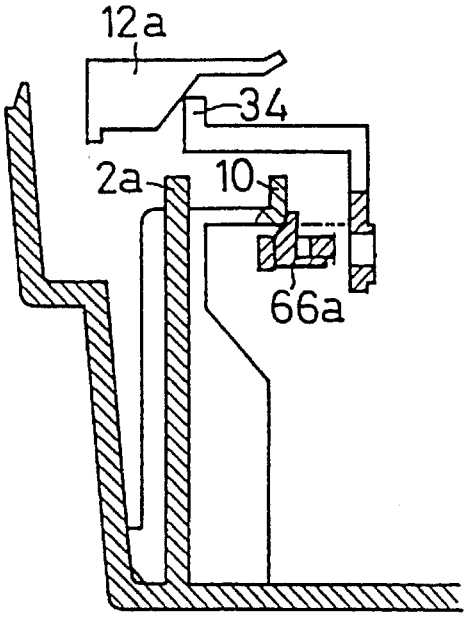
FIGS. 11 and 12 are views similar to those of FIG. 8 and 9, showing the lock control member placed in a position different from that of FIGS. 8 and 9.
Figure 12:
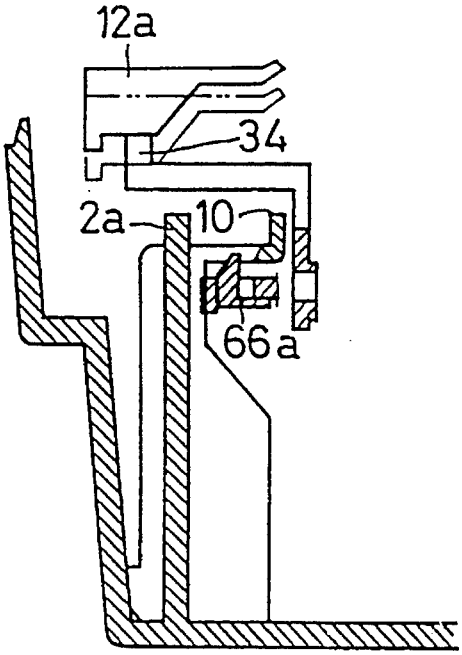

Thus, the engaging arm 66*d* of the movable locking member 66 is displaceable toward and away from the stationary engaging portion 10 in the direction (right and left directions in FIG. 10) parallel to the line of printing along the platen 6, and in the direction (up and down directions in FIG. 10) perpendicular to the line of printing. When the ribbon holder 24 is placed in the lower or predetermined initial position, the print head 8 can be moved from the zero position to the right, since the projection 66*a* is not inserted in the hole 10*a* as indicated in FIGS. 8 and 9. When the ribbon holder 24 is placed in the upper position, namely, not placed in the predetermined initial position (lower position), the print head 8 cannot be moved from the zero position, since the projection 66*a* is inserted into the hole 10*a* as indicated in FIG. 11 and 12.

Described more precisely, however, the print head 8 can be moved along the line of printing by a relatively small amount even when the projection 66*a* is held in engagement with the hole 10*a*. This amount of free movement of the print head 8 at or near the machine zero position when the ribbon holder 24 is in the upper position corresponds to an amount of play or clearance of the projection 66*a* with respect to the hole 10*a*, which in turn corresponds to about eight or nine steps of operation of the print head feeding stepping motor 7, as indicated in FIG. 14.

In the present embodiment, the overall range of movement of the print head corresponds to 1300 steps of operation of the stepping motor 7, and a substantial portion of this range is used as the normal printing range over which printing is possible on the recording medium. When the print head 8 is located at the machine zero position, the switching element 14*a* is held ON with the switch actuator 12 pivoted clockwise (in FIG. 3) by the pusher 34. The switching element 14*a* is predictably ON within a range corresponding to about 10 steps of operation of the stepping motor 7, as measured from the extreme left end of the movement range of the print head 24 (from the machine zero position). This predictable "ON" range of the switch 14*a* is slightly larger than the range corresponding to the free movement range of the print head 8 when the ribbon holder 24 is placed in the upper position, that is, when the projection 66*a* is inserted in the hole 10*a*. The overall movement range of the print head 8 includes an unpredictable "ON/OFF" range of the switching element 14*a* in which the operating state (ON or OFF: either zero-position signal or non-zero-position signal) of the switching element 14*a* is unpredictable. This unpredictable "ON/OFF" range corresponds to about 10 steps of operation of the motor 7 as measured from the end of the predictable "ON" range. Certain, a major portion of the overall movement range of the print head 8 is a predictable "OFF" range in which the switching element 14*a* is predictably OFF. In the predictably "ON" range, the switching element 14*a* is predictably ON without regard to the currently selected position of the ribbon holder 24, because of the arcuate surface of the pusher 34 engageable with the contact arm 12 of the switch actuator 12, as described above.

There will next be described the electronic controller 9 adapted to control the stepping motor 7, print head driver 37, etc.

The electronic controller 9 is principally constituted by a microcomputer, which incorporates a central processing unit (CPU) 70, a read-only memory (ROM) 72, a random-access memory (RAM) 74, an input/output port 76 and a bus 78, as well known in the art, except for specific control programs stored in the ROM 72 and executed by the CPU 70 for initializing the printing apparatus in relation to the zero position of the print head 8 and the initial position of the ribbon holder 24.

The input/output port 76 is adapted to receive signals from the matrix switch array 14, namely, signals generated by the operator-controlled switching elements operated by the keys on the keyboard 4, and zero-position and non-zero-position signals from the zero position sensing switching element 14*a*, which constitutes a part of the zero position sensor as explained above in detail. Appropriate control signals are fed from the controller 9 through the input/output port 76 to the stepping motor 7 for feeding or reciprocating the print head 8 along the platen 6, to the print head driver 37 for controlling the angular position of the print wheel 36 and the print hammer 42, and to the ribbon lift DC motor 52 and the solenoid 64 of the ribbon selecting device for changing the position of the ribbon holder 24.

Figure 15:
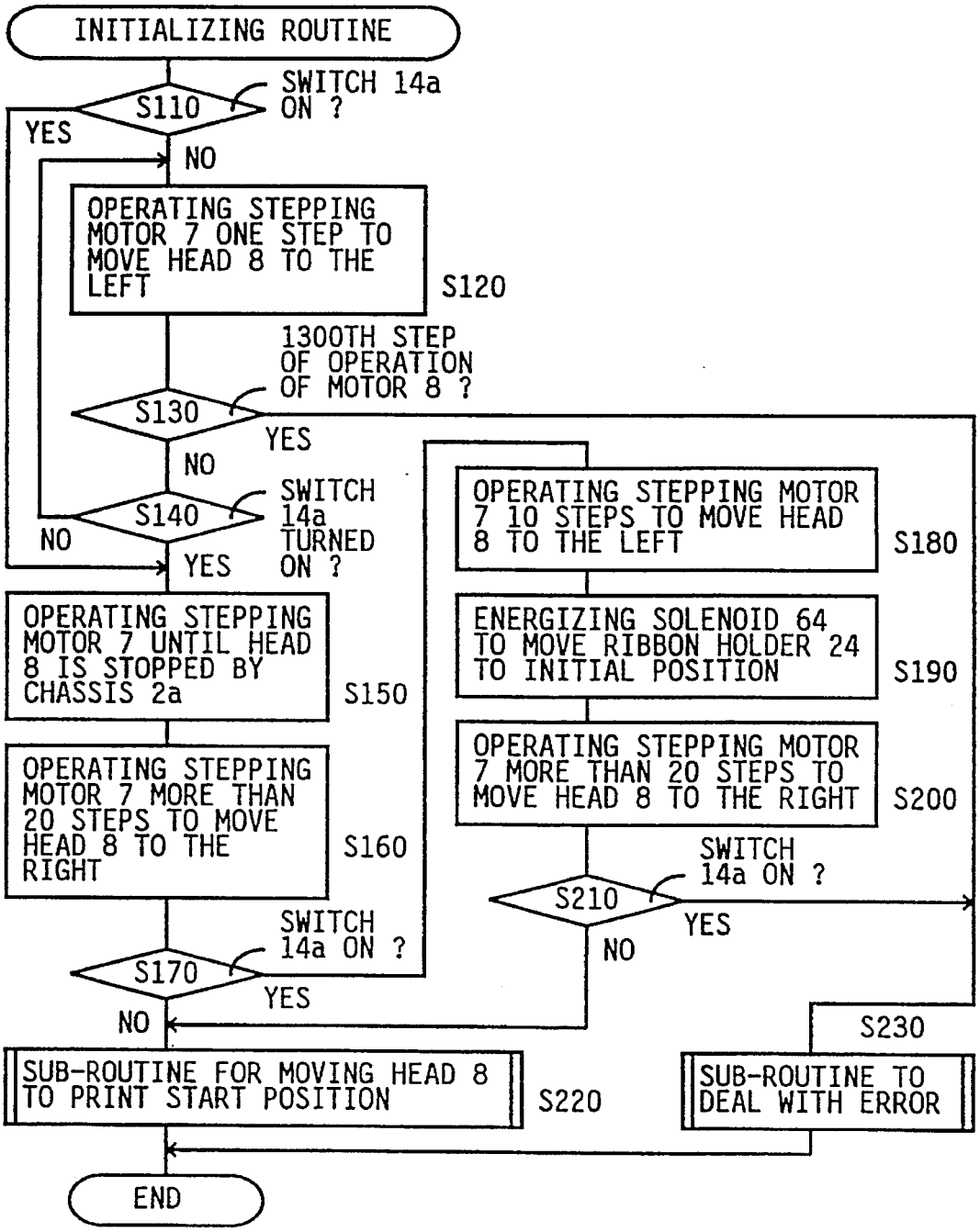
FIG. 15 is a flow chart illustrating an initializing routine of the typewriter.

When the present electronic typewriter as one form of a printing apparatus according to the present invention is turned on with a power switch turned on, or when the electronic controller 9 is reset, the CPU 70 performs an initializing routine as illustrated in the flow chart of FIG. 15. In this respect, it is noted that the DC motor 52 has been turned on when the initializing routine is started.

The initializing routine is initiated with step S110 to determine whether the switching element 14*a* (hereinafter referred to simply as "switch 14*a*") is ON (whether the zero-position signal is generated). Usually, the print head 8 is not located at the zero position when the typewriter is turned on. If a negative decision (NO) is obtained in step S110, the control flow goes to step S120 in which the stepping motor 7 is operated by one step to move the print head to the left, that is, toward the zero position. Step S120 is followed by step S130 to determine whether the stepping motor 7 has been operated by 1300 steps corresponding to the overall movement range of the print head 8. If a negative decision (NO) is obtained in Step S130, step S140 is implemented to determine whether the switch 14*a* is ON. If the switch 14*a* is still OFF, the control flow returns to step S120. Steps S120, S130 and S140 are repeatedly implemented until the switch 14*a* is turned 0N (until an affirmative decision is obtained in step S140). Normally, the switch 14*a* is turned ON before the stepping motor 7 is operated by 1300 steps. If an affirmative decision (YES) is obtained in step S130, or if the stepping motor 7 is operated by 1300 steps before the switch 14*a* is turned ON, this means that there exists some error associated with the zero position sensor 12, 14*a*, 34 or the print head feeding system including the stepping motor 7. In this case, the control flow goes to step S230 to execute a sub-routine for dealing with the error.

If an affirmative decision (YES) is obtained in step S110 or S140, this means that the print head 8 is now located within the predictable "ON" range or unpredictable "ON/OFF" range as indicated in FIG. 14. In this case, step S150 is implemented to operate the stepping motor 20 steps to move the print head 8 to the extreme left end of the overall movement range of the print head, that is, to the machine zero position at which the print head 8 or carriage 20 is stopped by abutting contact with the left chassis 2*a*. Usually, the print head 8 is mechanically stopped by the left chassis 2*a* at the machine zero position before the stepping motor 7 has been operated by 20 steps, and the stepping motor 7 is placed under out-of-synchronization condition during a terminal portion of the 1300 steps of operations. This assures a movement of the print head 8 to the machine zero position. Thus, the print head 8 is brought to the machine zero position.

If the ribbon holder 24 is not placed in the predetermined initial position, that is, not placed in the lower position for the printing ribbon 26*a*, namely, if the ribbon holder 24 is placed in the upper position for the correction ribbon 28, the projection 66*a* of the print head locking member 66 engages the hole 10*a* of the engaging portion 10 of the left chassis 2*a* when the print head 8 is returned to the machine zero position in step S150. In this case, the print head 8 cannot be moved away from the machine zero position.

Step S150 is followed by step S160 to operate the stepping motor 7 by more than 20 steps to move the print head 8 to the right, that is, in the direction away from the machine zero position, to a predetermined printing zero position in which the switch 14*a* is predictably turned OFF. Then, step S170 is implemented to determine whether the switch 14*a* is ON. Although the stepping motor 7 is operated in step S160, this does not necessarily mean that the print head 8 is actually moved to the printing zero position. Described in detail, if the stepping motor 7 is operated in step S160 while the ribbon holder 24 is placed in the upper position, the print head 8 cannot be moved away from the machine zero position to the printing zero position, due to the engagement of the projection 66 of the locking member 66 with the hole 10*a* of the engaging portion 10. In this case, the switch 14*a* is held ON. Thus, a negative decision (NO) in step S170 indicates that the ribbon holder 24 is now placed in the predetermined initial position (lower position). In this case, the ribbon holder 24 need not be initialized, and the control flow goes to step S220 to execute a sub-routine for moving the print head 8 to a predetermined print start position, which is normally the left end of the normal printing range as indicated in FIG. 14.

On the other hand, an affirmative decision (YES) in step

S170 indicates that the ribbon holder 24 is now placed in the upper position, and should be brought to the predetermined initial position (lower position) so that the typewriter is ready for printing using the printing ribbon 26*a*. To this end, steps S180–S210 are implemented. Step S180 is provided to operate the stepping motor 7 by 10 steps to move the print head 8 to the left, that is, to the machine zero position. In this respect, it is noted that the print head 8 has been moved in step S160 to the right by a small distance corresponding to about eight or nine steps of operation of the motor 7, which corresponds to the amount of clearance between the projection 66*a* and the hole 10*a*. Step S180 is followed by step S190 in which the solenoid 64 of the ribbon selecting device is energized to disengage the armature arm 60 from the currently selected protrusion 58*a* of the clutch collar 58, to cause the ribbon lift cam 46 to rotate through 180 degrees (with the DC motor 52 held operated), whereby the ribbon holder 24 is pivoted to the lower position (predetermined initial position). Thus, the ribbon holder 24 is initialized in step S190.

Then, the control flow goes to step S200 to operate the stepping motor 7 by more than 20 steps to move the print head 8 to the printing zero position (described above with respect to step S160). Usually, the print head 8 is actually moved to this printing zero position and the switch 14*a* is turned OFF, as a result of the operation of the stepping motor 7 in step S200, since the projection 66*a* has been disengaged from the hole 10*a* by a pivotal movement of the ribbon holder 24 (pivotal movement of the locking member 66) in step S190. In other words, a negative decision (NO) is usually obtained in the following step S210 provided to determine whether the switch 14*a* is ON. In this case, step S220 is implemented to execute the sub-routine for moving the print head 8 to the predetermined print start position as described above. If an affirmative decision (YES) is obtained in step S210, this means that there exists some error associated with the zero position sensor 12, 14*a*, 34 or the ribbon selecting device 44, 50, 52, 56, 58, 59, 60, 64. In this case, step S230 is implemented to execute the sub-routine for dealing with the error.

As described above, the print head 8 is initially returned to the machine zero position in steps S120–S150 if the print head 8 is not located at the machine zero position when the typewriter is initially turned on or when the controller 9 is reset. Further, the ribbon holder 24 is initialized, namely, brought to the predetermined initial position (lower position for printing with the printing ribbon 26*a*) in step S190 if the ribbon holder 24 is not placed in the initial position when the typewriter is initially turned on or when the controller 9 is reset.

It will be understood that the currently selected position of the ribbon holder 24 can be determined by first applying a zero return signal to the stepping motor 7 commanding the motor 7 to operate to move the print head to the machine zero position, then applying an off-zero movement signal to the stepping motor 7 commanding the motor 7 to operate to move the print head 8 to the printing zero position within the predictable "OFF" range, and finally checking the operating state (either ON or OFF) of the switch 14*a* after the off-zero movement signal is applied to the stepping motor 7. This determination of the currently selected position of the ribbon holder 24 is possible owing to the provision of the zero position sensor including the switch actuator 12, switching element 14*a* and pusher 34, and the provision of the print head locking mechanism including the stationary engaging portion 10 (hole 10*a*) and the movable lock control member 65 and locking member 66 (projection 66*a*). In particular, it is noted that the switch 14*a* remains ON even after the stepping motor 7 is operated to move the print head 8 from the zero position to the printing zero position within the predictable "OFF" range, unless the ribbon holder 24 has been placed in the predetermined initial position. Thus, the single zero position sensor or single zero position sensing switch 14*a* and the print head locking mechanism are enough to detect the zero position of the print head and the currently selected position of the ribbon holder 24. In other words, the switch 14*a* cooperates with the locking mechanism to effect a determination as to whether the print head 8 is located at the zero position, and a determination as to whether the ribbon holder 24 is placed in the predetermined initial position or not.

If it is found that the ribbon holder 24 is not placed in the initial position, the ribbon holder 24 can be readily brought to the initial position by simply energizing the solenoid 64 (in step S190) preferably after returning the print head 8 to the zero position (in step S180).

In the present embodiment, the print head 8 does not incorporates any part or member of the zero position sensor. The print head assembly including the print head 8 and ribbon holder 24 simply carries the pusher 34 engageable with the switch actuator 12 for closing the switching element 14*a*, and the locking member 66 having the projection 66*a* engageable with the hole 10*a* in the chassis 2*a*. The switching element 14*a* which is the only electrical portion of the zero position sensor is incorporated within the matrix switch array 14 in the lower part of the keyboard 4. Thus, the print head assembly does not incorporate any switching element or elements and doe not carry any electrical wires for signals from such switching elements. Thus, the print head assembly 8, 24, etc. can be readily assembled and installed on the carriage 20.

Since an unassigned one of the switching elements of the matrix switch array 14 is used as the zero position sensing switching element 14*a*, no exclusive switching element need to be provided for the zero position sensor, and no signal wire is necessary for such exclusive switching element. This simplifies the electrical system and reduces a problem of noise associated with the otherwise required signal line for the zero position sensor.

While the present invention has been described in detail in its presently preferred embodiment with a certain degree of particularity, it is to be understood that the present invention is not limited to the details of the illustrated embodiment, may be otherwise embodied without departing from the spirit of the invention, in the light of the foregoing teaching.

For instance, the initializing routine may be modified so as to eliminate steps S200 and S210. In the illustrated embodiment wherein the ribbon holder 24 has two. positions corresponding to the two ribbons (printing ribbon 26*a* and correction ribbon 28), the ribbon holder 24 is necessarily moved from the currently selected position (which is not the predetermined initial position) to the predetermined initial position by implementing step S190, that is, by energizing the solenoid 64 once. Therefore, the switch 14*a* is necessarily turned OFF if the print head 8 is moved from the machine zero position to the printing zero position within the predictably "OFF" position.

Further, steps S160 and S200 may be modified so that the stepping motor 7 is commanded to move the print head to the print start position (described above with respect to step S220), rather than the printing zero position. In this case, step S220 is eliminated.

Although the printing ribbon 26*a* and the correction ribbon 28 are supported on the ribbon holder 24 in the illustrated embodiment, two printing ribbons such as a black and a red ribbon may be used. In this case, the initial position of the ribbon holder 24 corresponds to the black ribbon, for example. Further, the ribbon holder 24 is adapted to support three or more ribbons, such as two printing ribbons and one correction ribbon.

Further, the ribbon holder 24 may have at least one dummy position which does not correspond to any ribbon. Such dummy position may be used as the predetermined initial position. In this case, the ribbon holder 24 is initially placed in a dummy position in which no ribbon is aligned with the line of printing, so that a line of characters already if printed on the recording medium is visible without being covered by a ribbon. The present invention is applicable to a printing apparatus in which a ribbon holder for holding at least one ribbon has at least two operating positions, one of which is selected as the initial position that is selected upon initialization of the printing apparatus.

What is claimed is:

1. A printing apparatus, said printing apparatus comprising: (a) a platen for supporting a recording medium, (b) a print head for printing on said recording medium within a printing range along a line of printing parallel to said platen, said print head being reciprocable along said line of printing, within a predetermined movement range including said printing range, (c) a head feeding motor for moving said print head along said line of printing selectively in a first direction toward a zero position selected within said movement range and outside said printing range, and a second direction away from said zero position, (d) a ribbon holder for supporting at least one ribbon such that an active portion of each of said at least one ribbon is used between said print head and said platen, (e) a support mechanism for supporting said ribbon holder such that said ribbon holder is reciprocable with said print head along said line of printing and has a plurality of operating positions which are spaced from each other in a direction intersecting said line of printing, said operating positions including a predetermined initial position in which said ribbon holder is placed upon initialization of the printing apparatus, and (f) a position selecting device including an actuator for placing said ribbon holder selectively in one of said operating positions;

a zero position sensor generating a zero-position signal when said print head is placed in said zero position, and a non-zero-position signal when said print head is spaced apart from said zero position;

a print head locking mechanism for permitting a movement of said print head from said zero position in said second direction when said ribbon holder is placed in said predetermined initial position, and inhibiting said movement of said print head from said zero position in said second direction when said ribbon holder is not placed in said initial position; and ribbon holder initializing means for effecting a ribbon initializing operation to place said ribbon holder in said initial position, said ribbon holder initializing means: applying to said head feeding motor a zero return signal commanding said feeding motor to operate to move said print head in said first direction to said zero position; applying to said feeding motor a first off-zero movement signal commanding said feeding motor to operate to move said print head in said second direction to a predetermined position spaced from said zero position in said second direction; and if said zero-position signal remains after said off-zero movement signal is applied to said feeding motor, commanding said position selecting device to operate to move said ribbon holder from a currently selected one of said plurality of operating positions to another.

2. A printing apparatus according to claim 1, wherein if said zero-position signal remains after said first off-zero movement signal is applied to said feeding motor, said ribbon holder initializing means repeats an operation including commanding said position selecting device to operate to change the position of said ribbon holder, applying to said feeding motor a second off-zero movement signal, and determining whether said non-zero-position signal is generated after said second off-zero movement signal is applied to said head feeding motor, said ribbon holder initializing means terminating said initializing operation when said non-zero-position signal is generated as a result of a movement of said print head according to said another off-zero movement signal.

3. A printer according to claim 2, wherein said ribbon holder initializing means terminates said ribbon initializing operation if said zero-position signal is changed to said non-zero-position signal after said first off-zero movement signal is applied to said feeding motor.

4. A printing apparatus according to claim 1, wherein said ribbon holder initializing means applies to said head feeding motor a signal commanding said feeding motor to operate to move said print head by a predetermined amount in said first direction toward said zero position before commanding said position selecting device to operate to move said ribbon holder from the currently selected operating position to another, if said zero-position signal remains after each of said first and second said off-zero movement signals is applied to said feeding motor.

5. A printing apparatus according to claim 1, wherein said zero position sensor comprises:

a movable portion which is reciprocated with said print head along said line of printing; and a stationary portion having a signal generator which is actuated by said movable portion to generate said zero-position signal when said print head is located at said zero position, said signal generator generating said non-zero-position signal when said print head is not located at said zero position.

6. A printing apparatus according to claim 5, further comprising a housing, a keyboard portion provided in a front portion of said housing, and a printing portion which is disposed behind said keyboard portion and which includes said platen, said print head, said head feeding motor and said ribbon holder, and wherein said keyboard portion comprises a plurality of keys operated by an operator of the apparatus, and a matrix switch array including a plurality of switching elements comprising operator-controlled switching elements which are opened and closed by said plurality of keys, respectively, whereby said printing apparatus takes the form of an electronic typewriter, and wherein said plurality of switching elements further comprise a zero position sensing switching element as well as said operator-controlled switching elements, and said stationary portion of said zero position sensor comprises:

said zero position sensing switching element which operates as said signal generator; and a switch actuator which is disposed such that said switch actuator is operated by said movable portion to actuate said zero position sensing switching element when said print head is located at said zero position, so that said zero position sensing switching element generates said zero-position signal when said print head is located at said zero position.

7. A printing apparatus according to claim 6, wherein said switch actuator comprises a first arm portion engageable with said movable member when said print head is moved to said zero position, and a second arm portion engageable with said zero position sensing switching element when said first arm portion engages said movable member, said switch actuator being pivotally supported by said housing at an intermediate portion thereof from which said first and second arm portions extend, said second arm portion being displaced for engagement with said zero position sensing switching element, as a result of a pivotal movement of said switch actuator upon engagement of said first arm portion with said movable member, whereby said zero position sensing switching element generates said zero-position signal when said print head is moved to said zero position.

8. A printing apparatus according to claim 7, wherein said support mechanism supports said ribbon holder pivotally about a first pivot axis parallel to said line of printing along said platen, and said movable portion of said zero position sensor includes an arcuate portion provided on a member which is pivoted with said ribbon holder, said arcuate portion having an arcuate surface having an arc center on said first pivot axis of said ribbon holder, and wherein said switch actuator of said stationary portion of said zero position sensor is supported pivotally about a second pivot axis parallel to said line of printing, said first arm portion having a parallel surface near said zero position in said first direction and an inclined surface remote from said zero position in said second direction, said parallel and inclined surfaces being parallel and inclined to said line of printing, respectively and being contiguous to each other so as to form an angle larger than 180 degrees as measured outwardly of said parallel and inclined surfaces, said parallel and inclined surfaces being formed such that a line of force acting on said first arm portion and said arcuate surface of said arcuate portion is offset from said second pivot axis, and such that said arcuate portion first engages said inclined surface and then engages said parallel surface to thereby pivot said switch actuator about said second pivot axis as said arcuate portion is moved with said print head toward said zero position, said switch actuator being inhibited from pivoting by a pivotal movement of said ribbon holder about said first pivot axis.

9. A printing apparatus according to claim 1, wherein said print head locking mechanism comprises a first and a second engaging member which are displaceable relative to each other and which are engageable with and disengageable from each other, one of said first and second engaging members being provided on a stationary member of the apparatus, while the other of said first and second engaging members being provided on a movable member which is reciprocated with said print head, said first and second engaging members moving toward each other as said print head is moved toward said zero point, and engaging each other to inhibit a movement of said print head away from said zero position when said ribbon holder is not placed in said initial position, said first and second engaging members being spaced apart from each other to permit a movement of said print head away from said zero position when said ribbon holder is placed in said initial position.

10. A printing apparatus according to claim 9, wherein said one of said first and second engaging members has a hole, while said other of said first and second engaging members has a projection which is engageable with said hole when said first and second engaging members are moved relative to each other in a direction intersecting said line of printing, at least one of said first and second engaging members including yielding means which permits said hole and said projection to move away from each other in said direction intersecting the line of printing, at least one of said projection and a portion defining said hole having an inclined surface which is inclined with respect to said line of printing and which is engageable with the other of said projection and said portion defining said hole, when said print head is moved to said zero position in said first direction while said ribbon holder is not placed in said initial position, said inclined surface cooperating with said yielding means to permit said projection to be inserted into said hole when said print head is moved to said zero position while said ribbon holder is not placed in said initial position.

11. A printing apparatus, said printing apparatus comprising: (a) a platen for supporting a recording medium, (b) a print head for printing on said recording medium within a printing range along a line of printing parallel to said platen, said print head being reciprocable along said line of printing, within a predetermined movement range including said printing range, (c) a head feeding motor for moving said print head along said line of printing selectively in a first direction toward a zero position selected within said movement range and outside said printing range, and a second direction away from said zero position, (d) a ribbon holder for supporting at least one ribbon such that an active portion of each of said at least one ribbon is used between said print head and said platen, (e) a support mechanism for supporting said ribbon holder such that said ribbon holder is reciprocable with said print head along said line of printing and has a plurality of operating positions which are spaced from each other in a direction intersecting said line of printing, said operating positions including a predetermined initial position in which said ribbon holder is placed upon initialization of the printing apparatus, and (f) a position selecting device including an actuator for placing said ribbon holder selectively in one of said operating positions;

a zero position sensor generating a zero-position signal when said print head is placed in said zero position, and a non-zero-position signal when said print head is spaced apart from said zero position;

a print head locking mechanism for permitting a movement of said print head from said zero position in said second direction when said ribbon holder is placed in said predetermined initial position, and inhibiting said movement of said print head from said zero position in said second direction when said ribbon holder is not placed in said initial position; and initializing means for effecting a print head and ribbon initializing operation to move said print head to said zero position and to place said ribbon holder in said initial position, said initializing means: applying to said head feeding motor a first zero return signal commanding said feeding motor to operate to move said print head in said first direction to said zero position; applying to said feeding motor a first off-zero movement signal commanding said feeding motor to operate to move said print head in said second direction to a predetermined position spaced from said zero position in said second direction; and if said zero-position signal remains after said first off-zero movement signal is applied to said feeding motor, repeating a ribbon initializing operation including commanding said position selecting device to operate to move said ribbon holder from a currently selected one of said plurality of operating positions to another, applying to said feeding motor a second off-zero movement signal, determining whether said non-zero-position signal is generated after said second off-zero movement signal is applied to said head feeding motor, and if said zero-position remains after said second off-zero movement signal is applied to said head feeding motor, applying to said head feeding motor a second zero return signal commanding again said head feeding motor to operate to move said print head to said zero position, said initializing means repeating said ribbon initializing operation until said non-zero-position signal is generated as a result of a movement of said print head according to said second off-zero movement signal, said initializing means terminating said print head and ribbon initializing operation when said non-zero-position signal is generated after said second off-zero movement signal is applied to said head feeding motor, and wherein said initiating means terminates said print head and ribbon initializing operation if said non-zero-position signal is generated after said first off-zero movement signal is applied to said head feeding motor.

12. A printing apparatus according to claim 11, wherein one of a left end and a right end of said movement range of said print head is selected as a machine zero point, and said print head has a printing zero position in the vicinity of one of a left end and a right end of said printing range, said one of said left and right ends of said printing range being nearer to said machine zero point than the other of said left and right ends of said printing range, said zero position sensor generating said zero-position signal when said print head is located within a non-printing range which is within said movement range and outside said printing range, one of opposite ends of said non-printing range being defined by said machine zero point, said zero position sensor generating said non-zero-position signal when said print head is located outside said non-printing range, said print head locking mechanism permitting said print head to move in a direction from said non-printing range toward said printing range when said print ribbon holder is placed in said predetermined initial position, and inhibiting said print head from moving in said direction from said non-printing range toward said printing range, and wherein said initializing means comprises:

means for commanding said head feeding motor to operate to move said print head in a direction from said printing range toward said non-printing range until said zero-position signal is generated;

means commanding said head feeding motor to operate to move said print head in said direction from said non-printing range toward said printing range to said print start point;

means operable when said zero-position signal remains after said head feeding motor is commanded to move said print head to said printing zero position, for first commanding said head feeding motor to operate to move said print head to said machine zero position, then commanding said position selecting device to operate to change the position of said ribbon holder, then commanding said head feeding motor to operate to move said print head to said printing zero position, determining whether said zero-position signal is changed to said non-zero-position signal, and terminating said ribbon initializing operation and a print head initializing operation to move said print head to said printing zero position when said zero-position signal is changed to said non-zero-position signal; and means operable when said zero-position signal is changed to said non-zero-position signal after head feeding motor is first commanded to operate to move said print head to said machine zero position, for terminating said ribbon initializing operation and said print head initializing operation.

* * * * *